United States Patent [19]

Ito et al.

[11] 4,419,143

[45] Dec. 6, 1983

[54] METHOD FOR MANUFACTURE OF ALUMINUM ALLOY CASTING

[75] Inventors: Tadao Ito, Fuji; Akio Hashimoto, Numazu, both of Japan

[73] Assignee: Nippon Light Metal Company Limited, Tokyo, Japan

[21] Appl. No.: 321,882

[22] Filed: Nov. 16, 1981

[51] Int. Cl.[3] ..... C22F 1/04

[52] U.S. Cl. ..... 148/3; 148/159; 148/416; 148/417

[58] Field of Search ..... 148/3, 159, 32.5

[56] References Cited

FOREIGN PATENT DOCUMENTS 37-10901 8/1962 Japan .

*Primary Examiner*—R. Dean

*Attorney, Agent, or Firm*—William J. Daniel

[57] ABSTRACT

A cast article of aluminum alloy is produced by pouring into a mold a molten Al-Si-Cu type or Al-Si-Cu-mg type casting alloy having an antimony (Sb) content in the range of about 0.03%-1.0% by weight and, while the alloy cast body is cooling following complete solidification but before its temperature has fallen below 450° C., placing the solidified cast body into a heating furnace kept at temperatures in the range of from 480° to 530° C. and retaining it at an intermediately high-temperature within that temperature range for not more than two hours, subsequently quenching said cast body in cold water or hot water and thereafter subjecting the quenched cast body to a treatment for artificial aging at temperatures in the range of from 140° to 230° C. for a period in the range of from one to 12 hours.

The resulting cast articles are, in terms of strength, toughness and resistance to thermal shocks, comparable with or superior to cast articles obtained by conventional methods but can be manufactured in a reduced period of time with consequential savings in cost.

5 Claims, 2 Drawing Figures

FIG. 1 – COMPARATIVE PROCESS FLOW DIAGRAM
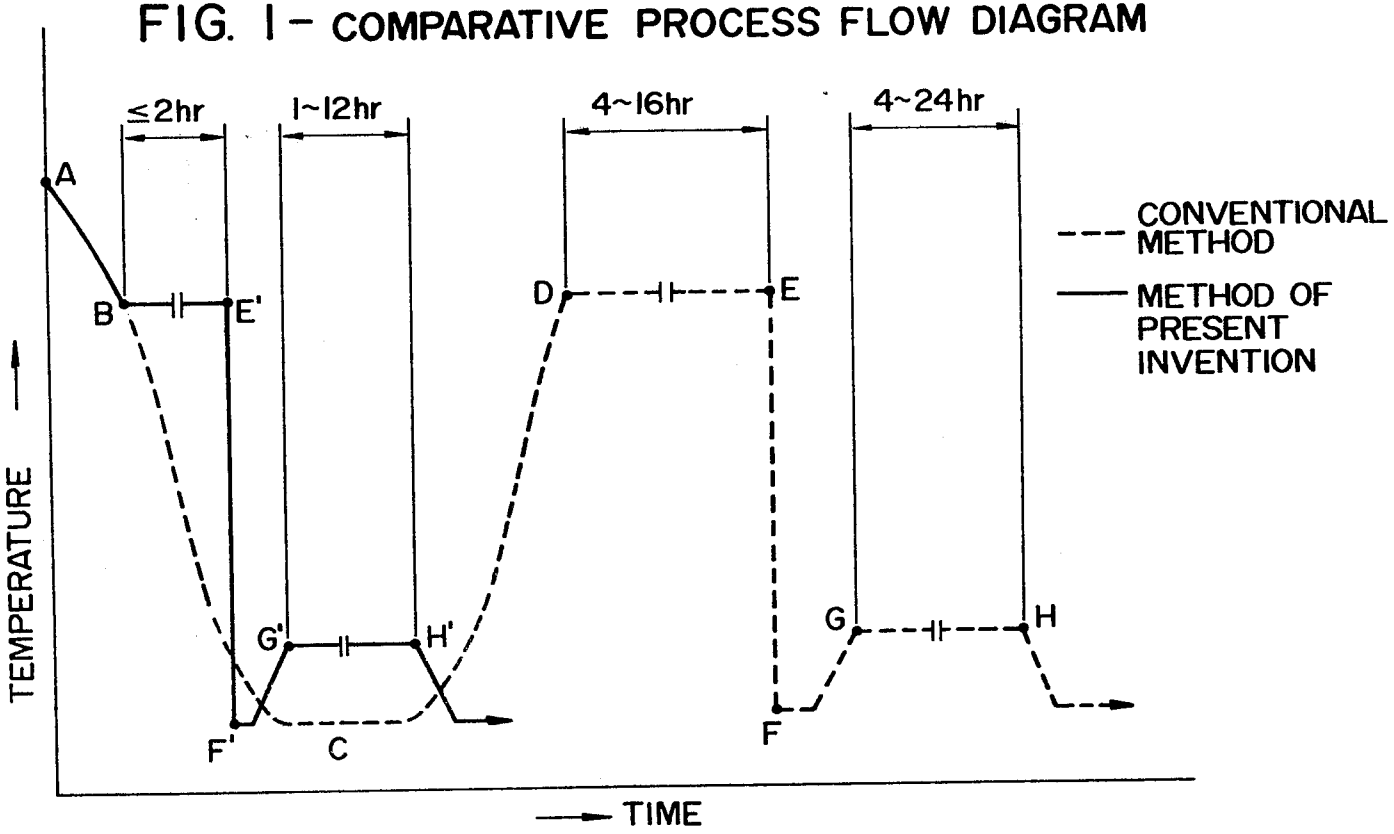

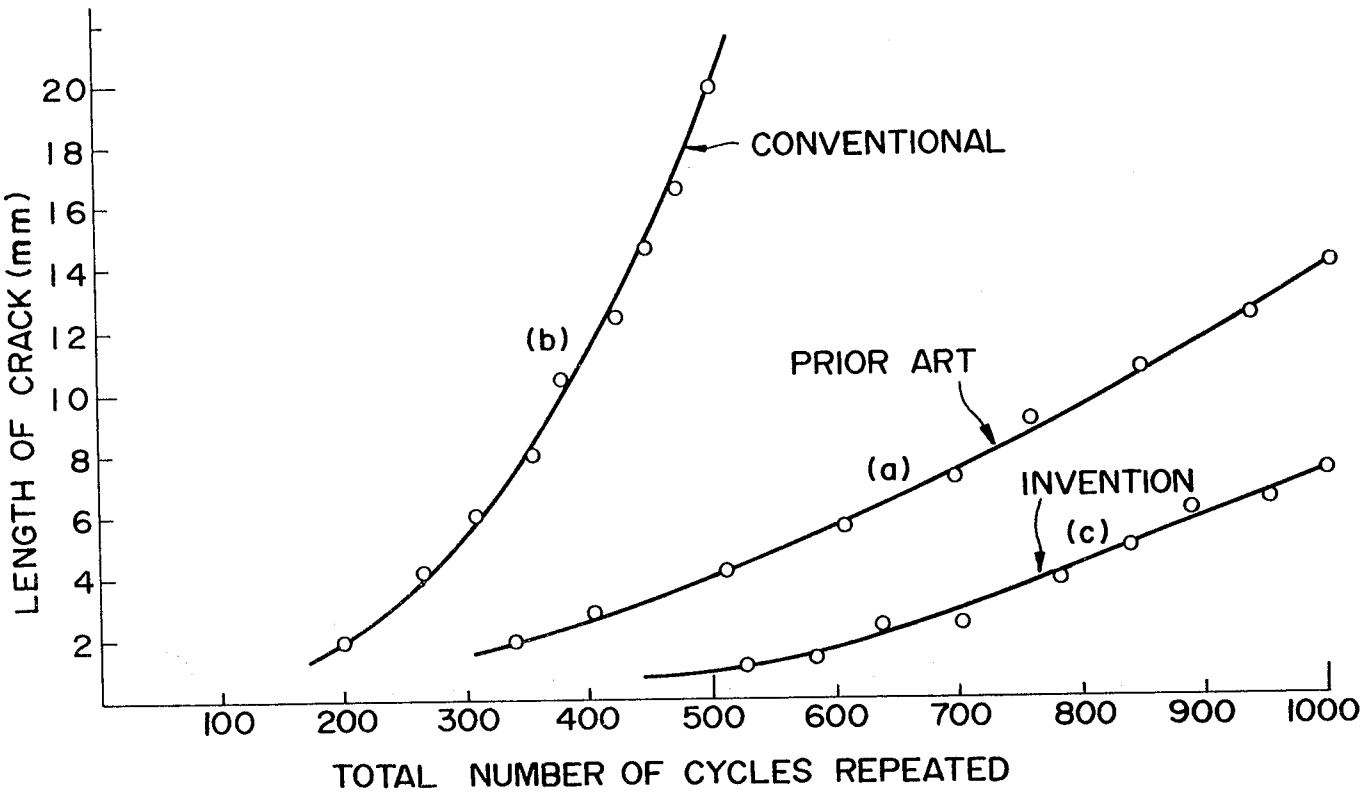
FIG. 2 - RESISTANCE TO THERMAL SHOCK

METHOD FOR MANUFACTURE OF ALUMINUM ALLOY CASTING

BACKGROUND OF THE INVENTION

1. Field of the Invention

This invention relates to an improved method for the manufacture of cast articles from Al-Si-Cu type or Al-Si-Cu-Mg type casting alloys.

The term "Al-Si-Cu type casting alloys" as used herein means the Al-Si-Cu alloys of the type corresponding to those designated as AC2A, AC2B and AC4B by Japanese Industrial Standard for Aluminum Alloy Castings (JIS H5202) and the term "Al-Si-Cu-Mg type casting alloys" as used herein means the Al-Si-Cu-Mg alloys of the type corresponding to those designated as AC4D, AC8A, AC8B and AC8C by JIS H5202.

Since these Al-Si-Cu type and Al-Si-Cu-Mg type casting alloys have good casting properties, possess appropriate strength and toughness and excel in resistance to thermal shock, they are widely used for casting parts for engines in automobiles and ships and other machine parts.

2. Description of the Prior Art

Heretofore in the manufacture of cast articles of the alloys in question, the alloy cast bodies obtained by casting the molten alloy material into molds had to be subjected to a solution heat treatment and then to quenching and an artificial aging heat treatment in order to acquire the necessary strength and toughness. This solid solution heat treatment has to be carried out at elevated temperatures within the range of from 500° to 530° C. for long periods ranging from several hours to ten or more hours. Further, the treatment for artificial aging has to be continued at temperatures within the range of from 140° to 230° C. for similarly long periods ranging from several hours to ten or more hours. These treatments have necessarily affected the casting operation adversely notably from the standpoints of production efficiency and heat economy.

With a view to avoiding these disadvantages involved in the casting of the type requiring thermal treatment, there has been proposed a method which, as disclosed in Japanese Patent Publication No. 10901/1962, for example, comprises quenching the cast body to room temperature immediately after casting, thereby simultaneously effecting quenching and formation of supersaturated solid solutions and subsequently subjecting said cast body to treatment for artificial again.

When the latter method is applied to the alloys of the present invention, since the Cu component, among other components of the alloys, cannot be made to form a thorough solid solution, the cast articles fail to acquire sufficient strength from the thermal treatment. Because of the absence of a uniform solid solution, the cast articles suffer from notable variation in strength distribution, sustain serious deformation and offer insufficient resistance to thermal shock.

SUMMARY OF THE INVENTION

The inventors have studied the various drawbacks encountered in the manufacture of cast articles from alloys of the aforementioned types and have discovered that, by adding antimony in a small amount to the alloys of these types in question and, preparatory to the quenching treatment, interrupting the normal cooling stage following casting while the cast bodies are at an intermediate high temperature and retaining said cast bodies at that high temperature for a limited time, the cast articles at the end of the treatment for artificial aging have acquired a degree of strength, toughness and resistance to thermal shock comparable with or even superior to those imparted by the conventional methods even if the period of the retention at the intermediate high temperature is very short.

An object of this invention, therefore, is to provide an economic method for manufacturing aluminum alloy cast articles comparable with or superior to conventional products in quality.

Specifically, this invention relates to a method for the manufacture of cast article of aluminum alloy, characterized by the steps of pouring into a suitable mold molten Al-Si-Cu or Al-Si-Cu-Mg type alloy containing antimony (Sb) in a proportion in the range of from about 0.03% to 1.0% by weight and, after the molten alloy has solidified and is cooling, introducing the solidified cast body into a heating furnace kept at temperatures in the range of from 480° to 530° C. before the temperature of said cast body has cooled to below 450° C., retaining said cast body at the latter intermediate high temperature for a short period, subsequently quenching said cast body in cold water or hot water and thereafter subjecting the quenched said cast body to a treatment for artificial aging at temperatures within the range of from 140° to 230° C. for a period of not less than one hour.

BRIEF DESCRIPTION OF THE DRAWINGS

FIG. 1 is a model flow diagram of the manufacture of cast articles of an Al-Si-Cu or Al-Si-Cu-Mg type alloy according to the method of the present invention and the conventional method.

FIG. 2 is a graph comparing the resistance to thermal shock obtained of the cast articles manufactured by the method of this invention and the conventional method.

DETAILED DESCRIPTION OF THE INVENTION

According to this invention, when the aluminum alloy cast body which has just been solidified in the metal mold is retained briefly at a specified high temperature, it can be immediately subjected to the subsequent treatments for quenching and artificial aging. Since the time-consuming solid solution heat treatment is no longer required and the treatment for artificial aging is brought to completion in considerably reduced time, the time required for the manufacture of cast articles can be notably shortened and all the treatments involved can be performed continuously. Thus, the method of this invention not only enhances production efficiency but also proves highly advantageous from the standpoint of heat economy.

Now, the present invention will be described, in comparison with the conventional method, with reference to the model flow diagram of FIG. 1. In FIG. 1, the solid line denotes the process flow by the present invention and the broken line that by the conventional method.

In the diagram, the alphabetic symbols used to designate the various process steps involved are explained below.

| (Conventional method) | | (Method of this invention) | |
|---|---|---|---|
| A → B | Completion of | A → B (B') | Completion of |

-continued

| (Conventional method) | | (Method of this invention) | |
|---|---|---|---|
| | solidification | | solidification |
| B → C | Spontaneous | B (B') → E' | Retention at intermediate high temperature |
| C → D | Heating for temperature elevation | E' → F' | Quenching |
| D → E | Treatment for solid solution | F' → C' → H' | Treatment for artificial aging |
| E → F | Quenching | | |
| F → G H | Treatment for artificial aging | | |

By the conventional method, the cast articles of an Al-Si-Cu type or Al-Si-Cu-Mg type alloy are manufactured by the steps of pouring into the metal mount mold a molten alloy at a temperature in the neighborhood of 720° C. and, after the molten alloy has been completely solidified, allowing the solid cast bodies to cool off spontaneously from the temperature at the end of the solidification to room temperature (A→B→C), then heating the cast bodies to a temperature within the range of from 500° to 530° C. as needed for the solid solution heat treatment and retaining the cast bodies at this elevated temperature for a period of from four to 16 hours (C→D→E), subsequently quenching the cast bodies in cold water or in hot water at temperatures in the range of from 60° to 100° C. (E→F) and finally subjecting the cast bodies to aging at temperatures in the range of from 140° to 230° C. for a period of from four to 12 hours.

By the conventional method, therefore, the series of heat treatments calls for not less than 12 hours even on a conservative estimate.

By contrast, in the case of this invention, cast articles possessing degrees of strength and toughness fully comparable to those of the cast article produced by the conventional method as described above can be obtained by similarly causing the molten alloy to be solidified in the metal mold and, after the solidification is completed, placing the solid cast bodies in a heating furnace kept at temperatures within the range of from 480° to 530° C. while the cast bodies are still at a high temperature during cooling retaining the cast bodies therein at this intermediate high temperature for a short period (up to two hours) (A→B→E'), then immediately quenching the cast bodies in cold water or hot water (E'→F'), and thereafter subjecting the quenched cast bodies to a treatment for artificial aging at temperatures in the range of from 140° to 230° C. for one to 12 hours. As a whole, the time required for the manufacture of the cast articles are notably decreased and the steps can be readily performed in a continuous operation.

The continuous operation can incorporate or integrate the steps of casting the molten alloy into the mold, retaining the solidified cast bodies during their cooling at an intermediate high temperature and then immediately quenching the cast bodies in water. Optionally it may be extended to cover the subsequent step of giving the hardened alloy cast bodies the treatment for artificial aging.

The equipment needed for carrying out these steps continuously includes tunnel furnaces as the heating furnace at varying steps and use of link conveyors for advancing the cast articles between the adjacent steps. These facilities are well known in the art.

Now, the present invention will be described below with reference to working examples.

EXAMPLE 1: (TEST FOR STRENGTH)

Alloys of different compositions indicated in Table 1 (which lists alloys of the types designated as AC2B, AC4B and AC8C in JIS-H5202) were melted in a smelting furnace and, after thorough fusion therein, treated for expulsion of entrapped gas and removal of slag, subsequently poured at 720° C. into a boat-shaped testing mold of JIS H-5202 preheated to about 150° C. and, after complete solidification therein, subjected to varying after-treatments indicated below:

(a) Conventional method (1), comprising the steps of allowing the solidified alloy cast bodies to cool off spontaneously to room temperature, then subjecting the solid alloy cast bodies for solution heat treatment, and thereafter quenching and artificial aging.

(b) Known alternative method described in the Japanese Patent Publication No. 10901/1962 (2), comprising the steps of immediately quenching the solidified alloy cast bodies in water and subjecting the quenched alloy to treatment for artificial aging.

(c) Method of this invention, comprising the steps of immediately placing the solidified alloy cast bodies in a heating furnace, retaining it therein at an intermediate high temperature for a short time and thereafter subjecting the alloy to treatments for quenching and artificial aging.

Thereafter, the cast articles resulting from these after-treatments were tested for mechanical properties such as tensile strength, 0.2% yield strength and elongation. The results are shown in Table 1.

In the alloys of the type AC2B used in Sub-example (1), alloy (d) which contained sodium, a substance usually employed in alloys of this kind as an additive component for improvement of alloy cast structure, in lieu of antimony as an alloy component was subjected to the procedure of the present invention. The test results obtained of the casting of this alloy are also shown in the table for the purpose of comparision.

The conditions of the heat treatments given to the various alloys of Table 1 are summarized in Table 2.

TABLE 1

| Sub-example No. | Designation of alloy | Type of heat treatment | Chemical composition (%) | | | | | | Mechanical properties | | |
|---|---|---|---|---|---|---|---|---|---|---|---|
| | | | Cu | Si | Mg | Sb | Na | Al | Tensile strength (Kg/mm²) | 0.2% yield strength (Kg/mm²) | Elongation (%) |
| 1 | AC2B | a[1] | 3.8 | 6.2 | — | — | — | Balance | 39.0 | 34.8 | 1.7 |
| | | b[2] | 3.8 | 6.2 | — | — | — | " | 26.6 | 20.5 | 2.0 |
| | | c[3] | 3.9 | 6.3 | — | 0.12 | — | " | 38.9 | 34.6 | 1.9 |
| | | d[4] | 3.9 | 6.3 | — | — | 0.5 | " | 35.0 | 29.8 | 1.6 |
| 2 | AC4B | a[1] | 3.9 | 9.1 | — | — | — | " | 42.0 | 37.1 | 0.9 |
| | | b[2] | 3.9 | 9.1 | — | — | — | " | 31.9 | 28.6 | 0.9 |
| | | c[3] | 3.9 | 9.3 | — | 0.13 | — | " | 43.0 | 39.2 | 0.9 |

TABLE 1-continued

| Sub-example No. | Designation of alloy | Type of heat treatment | Chemical composition (%) Cu | Si | Mg | Sb | Na | Al | Mechanical properties Tensile strength (Kg/mm²) | 0.2% yield strength (Kg/mm²) | Elongation (%) |
|---|---|---|---|---|---|---|---|---|---|---|---|
| 3 | AC8C | a[1] | 3.0 | 10.3 | 0.6 | — | — | " | 39.6 | 34.5 | 1.1 |
| | | b[2] | 3.0 | 10.3 | 0.6 | — | — | " | 29.8 | 26.0 | 1.0 |
| | | c[3] | 3.1 | 10.4 | 0.5 | 0.20 | — | " | 38.9 | 34.0 | 1.5 |

[1]Conventional Method
[2]Method of Japanese P.P. No. 10901/1962
[3]Method of Invention
[4]Method of Invention Substituting Sodium for Antimony

TABLE 2

| Sub-example No. | Designation of alloy | Type of heat treatment | Solution heat treatment (Retention at intermediate high temperature) | Quenching | Artificial aging | Total time for heat treatment (hrs) |
|---|---|---|---|---|---|---|
| 1 | AC2B | a[1] | 500° C. × 4 hrs. | In water | 220° C. × 6 hrs. | 12 |
| | | b[2] | — | " | " | 7 |
| | | c[3] | 520° C. × 1 hr. | " | 220° C. × 3 hrs. | 5 |
| | | d[4] | " | " | " | 5 |
| 2 | AC4B | a[1] | 500° C. × 4 hrs. | " | 190° C. × 4 hrs. | 10 |
| | | b[2] | — | " | " | 5 |
| | | c[3] | 520° C. × 1 hr. | " | " | 6 |
| 3 | AC8C | a[1] | 500° C. × 10 hrs. | " | 200° C. × 4 hrs. | 16 |
| | | b[2] | — | " | " | 5 |
| | | c[3] | 500° C. × 1 hr. | " | 220° C. × 3 hrs. | 5 |

[1]Conventional Method
[2]Method of Japanese P.P. No. 10901/1962
[3]Method of Invention
[4]Method of Invention Substituting Sodium for Antimony From the test results of Table 1, it is evident that in any of Sub-examples (1), (2) and (3), the sample cast bodies obtained in Run (c) corresponding to the method of this invention wherein the quenching to be performed after complete solidification of the molten alloy in the mold was preceded by about one hour's retention at an intermediate high temperature and followed by a treatment for artificial aging, were, in terms of strength, comparable with or even superior to the sample cast bodies obtained in Run (a) wherein the cast bodies were subjected to the usual lengthy solution heat treatment and far superior to the sample cast bodies obtained in Run (b) wherein the cast bodies were subjected to quenching and artificial aging immediately after solidification without going through the retention at an intermediate high temperature.

It is evident from the test results for Run (d) in Sub-example (1) that the effect of the present invention reflected in the notable decrease in the total time required for the heat treatments cannot be obtained with the alloy using sodium for an improvement of cast structure in the place of antimony.

EXAMPLE 2: (ACTUAL TEST FOR RESISTANCE TO THERMAL SHOCK)

Alloys having the same compositions as specified for Sub-examples (3) of Example 1 were melted, treated for expulsion of entrapped gas and removal of slag and cast by the squeeze casting method under the conditions of 720° C. of temperature and 500 kg/cm² of pressure to form automobile piston heads 100 mm in diameter and 20 mm in height, were subjected respectively to the three heat treatments (a), (b) and (c) indicated in Example 1. From the resultant castings, discs 100 mm in diameter and 3 mm in thickness containing a circular hole 5 mm in diameter at the center were cut and used as test pieces. Each test piece was suddenly heated at the center with a burner and, after the temperature of the entire test piece reached 350° C., immediately quenched in water (20° C.). This cycle of sudden heating and sudden cooling was repeated until the circular hole at the center of the test piece sustained cracks due to thermal stress, with the total number of cycles repeated and the speed of propagation of cracks being noted. Based on the data thus obtained, the test pieces were rated for resistance to thermal shocks. The results are shown in FIG. 2.

It is clear from FIG. 2 that test piece (c) obtained by the method of this invention developed cracks after a notably larger number of cycles compared with test pieces (a) and (b) obtained by the conventional and prior art methods and that the propagation of cracks in test piece (c) occurred at a lower rate compared with the other test pieces (a) and (b). This data indicates that the products of the present invention excel in resistance to thermal shock.

As described above, from the Al-Si-Cu type and Al-Si-Cu-Mg type casting alloys which, because of their susceptibility to loss of strength and toughness have failed to respond to the simplified heat-treating method such as "solutioning casting method" entailing immediate treatments of the solidified alloy for quenching and artificial aging and which, therefore, have inevitably necessitated time-consuming heat treatments, the present invention produces cast articles possessing satisfactory strength and toughness by the steps of casting the molten alloy into the mold and, after solidification of the cast bodies, retaining the solid cast bodies at an intermediate high temperature briefly before they cool below a stated level, then quenching the cast bodies and subjecting the quenched cast bodies to an artificial againg treatment. Compared with the conventional methods, the method of this invention permits a drastic reduction in the overall time required for heat treatments without sacrificing strength and toughness of the products. Thus, the method proves ideal for the manufacture of cast articles from the aluminum alloys in question.

What is claimed is:

1. A method for the manufacture of a cast article of aluminum alloy, which comprises the steps of (a) pouring into a metal mold a molten Al-Si-Cu type or Al-Si-Cu-Mg type casting alloy containing antimony (Sb) in the range of 0.03–1.0% by weight; (b) after complete solidification of the alloy cast body in the mold but before it has cooled below about 450° C., placing said cast body in a heating furnace kept at temperatures in the range of from 480° to 530° C. and retaining it therein for a short period up to two hours; (c) then quenching said cast body; and (d) finally subjecting it to a treatment for artificial aging at temperatures in the range of about 140°–230° C. for not less than one hour.

2. The method according to claim 1, wherein said treatment for artificial aging is carried out for a period in the range of from one to 12 hours.

3. The method according to claim 1, wherein said quenching is carried out in cold water or hot water.

4. The method according to claim 1, wherein the steps of pouring the molten alloy into the metal mold, retaining the cast body at said furnace temperature and quenching are carried out in a continuous sequence.

5. The method according to claim 4, wherein the continuous sequence also includes said artificial aging treatment.

* * * * *